United States Patent [19]

Berry, III

[11] Patent Number: 4,703,312

[45] Date of Patent: Oct. 27, 1987

[54] VOICE-OVERRIDE ALARM SYSTEM

[75] Inventor: Robert W. Berry, III, Bridgeport, Conn.

[73] Assignee: Audiosone, Inc., Monroe, Conn.

[21] Appl. No.: 899,153

[22] Filed: Aug. 22, 1986

[51] Int. Cl.[4] ..... G08B 29/00

[52] U.S. Cl. ..... 340/506; 340/508; 340/509; 340/521; 340/692; 340/693; 379/43

[58] Field of Search ..... 340/506–513, 340/521, 531, 692, 693; 379/37–44, 49, 63, 80; 381/58, 59, 110

[56] References Cited

U.S. PATENT DOCUMENTS 3,906,491 9/1975 Gosswiller et al. ..... 340/509

4,060,803 11/1977 Ashworth, Jr. ..... 340/506

*Primary Examiner*—Donnie L. Crosland

*Attorney, Agent, or Firm*—H. Gibner Lehmann; K. Gibner Lehmann

[57] ABSTRACT

An emergency alarm system incorporating both signal generation and voice annunciation capabilities, for installation in a building or other structure. The system includes a standard fire alarm control panel and one or more loud speakers, each speaker having a series blocking capacitor. The panel has conventional supervisory circuitry and sensing/alarm terminals connected therewith, adapted to indicate an alarm condition when conditions warrant, as by signals received on multiple sensor lines that also communicate with the panel. A signal generator and amplifier are arranged to drive the speakers, under alarm conditions. There is provided a circuit-failure indicator including an electrical switch and an electro-responsive actuator device connected with the signal generator. The electro-responsive actuator device, when energized by the signal generator, maintains the switch in a closed-circuit condition. An electrically conducting loop circuit is connected with the sensing-/alarm terminals of the fire alarm control panel, the loop circuit involving the two speaker lines and a d.c. conducting shunt. The electrical switch is connected in series in the loop circuit whereby failure of either the signal generator or amplifier results in the open-circuiting of the switch, thereby distrubing the continuity of the loop circuit. By the above arrangement, breakage of either speaker line of the loop circuit, or open-circuiting of the electrical switch will result in activation of the sensing device of the fire alarm control panel, through solely its two sensing/alarm terminals, in order to indicate the existence of a trouble condition.

10 Claims, 4 Drawing Figures

VOICE-OVERRIDE ALARM SYSTEM

STATEMENT AS TO RIGHTS TO INVENTIONS MADE UNDER FEDERALLY-SPONSORED RESEARCH AND DEVELOPMENT

Research and development of the present invention and application have not been Federally-sponsored, and no rights are given under any Federal program.

BACKGROUND OF THE INVENTION

1. Field of the Invention

This invention relates to emergency alarm systems, and more particularly to alarm systems having signal devices and voice announcement capabilities, which latter are arranged to automatically override the signal devices when desired.

2. Description of the Related Art Including Information Disclosed Under 37 CFR §§1.97–1.99

It is generally recognized that conventional fire alarm control panels have now been developed to the point where they are considered to be highly reliable. In buildings protected by such panels, when an alarm is sounded the occupants readily acknowledge the existence of a potential danger and quickly vacate the premises. However, many such conventional alarm systems give no indication of the severity of the danger, nor where the danger point is, or what would be the best course of action to pursue, as well as whether or not the alarm might be false. A situation having variables such as these could result in either inaction, or improper action and unnecessary injury.

The above drawback has been recognized, and improvements have been made by replacing the electromechanical bells and horns with loud speakers, and by providing an electronically-generated alarm signal, such as a siren, with a capability for voice override whereby a qualified person can communicate important information to the building occupants in an emergency situation.

There exist several methods of upgrading an existing alarm system to one having both alarm signal and voice capabilities. One approach is to completely scrap the existing alarm panel and replace it with a modernized one having the desired voice amplification and speaker circuitry. However, this is usually very costly. An alternative is to add an adapter module which can provide the desired combined voice and signal capabilities while still retaining the advantages of alarm detection and circuitry supervision of the already existing fire alarm control panel.

A prior arrangement involving the addition of a module to an existing fire alarm control panel, but with some important differences, is disclosed in U.S. Pat. No. 4,258,332 issued to Henry W. West on Mar. 24, 1981, and entitled LOUDSPEAKER AMPLIFIER, this patent having been assigned to Wheelock Signals, Inc.

One of the important differences found in the Wheelock system is that it internally supervises the output or speaker circuit, then transmits the data which identifies the trouble condition to the existing panel by means of a normally closed relay contact which interrupts the alarm-initiating circuit. A drawback of such an arrangement is that the trouble condition, which may not be in the nature of a failure, can prevent the control panel from seeing or sensing the actual alarm input.

Also, in the Wheelock module identified above, a fault must be detected by two separate circuits in order to initiate a trouble indication, one circuit being in the existing panel and the other being in the added Wheelock circuitry. The undesired result of this arrangement is that there are two chances for circuit failure. Also, the added circuitry is relatively complex, involving multiple components, thereby introducing an additional likelihood of component failure or system malfunction.

Another drawback of the Wheelock system is the modulation of direct current by both voice and alarm signals. This increases complexity and cost, and reduces reliability and flexibility in the units, since only amplifier/speakers designed especially for the Wheelock unit can be utilized.

Also, with prior devices where the speakers are remotely located so as to be out of the range of the party making an announcement, there is no positive indication of the operativeness of the voice circuitry. Under such circumstances if the person speaking cannot hear an echo from a speaker, he thus cannot be sure that the message is being properly transmitted.

Battery back-up is required on all fire alarm control panels, and where an added module is employed, the power drawn thereby must be provided by such batteries. In the Wheelock patented device, the "standby" current is found to be fairly high, even exceeding that of the fire alarm control panel itself. Accordingly either larger batteries are required by the Wheelock system, or else there results a sacrifice in the time available during which such a system can operate prior to shut-down caused by discharge of such batteries.

SUMMARY OF THE INVENTION

The above disadvantages and drawbacks of prior interface modules of the type adapted to be connected to conventional fire alarm control panels are obviated by the present invention, which has for one object the provision of a novel and improved interface module which is simple in construction and reliable in operation, and which is completely compatible with virtually all existing fire alarm control panels, typically requiring only a simple six-wire hook-up thereto and two other connections for loud speakers.

Another object of the invention is to provide an improved interface module of the type noted, which has built-in, supplemental supervisory circuitry that enables simultaneous and continuous monitoring of its signal generator and amplifier portions at the same time that supervision of the speaker leads is occurring, thus insuring that all parts of the control panel/interface module are in an operative condition at any time.

Still another object of the invention is to provide an improved interface module as above set forth, wherein the same supervisory circuitry contained in the existing fire alarm control panel is employed for monitoring both the speaker lines and the signal generator/amplifier circuitry in the module, thus simplifying the module by eliminating a number of additional components which would be involved if a separate supervisory circuit and indicator were required in the module itself.

A still further object of the invention is to provide an improved interface module of the type indicated, wherein the standby current during non-alarm conditions is greatly reduced, so as to not constitute a significant additional drain on the fire alarm control panel back-up battery if a power failure occurs. There is thus extended the time during which the system can operate in the absence of commercial power. During such standby operation, the initiation of an alarm condition as sensed by the control panel will automatically result in the initiation of an alarm signal from the module, transmitting it over all speakers and including the option of voice-override, if desired.

Yet another object of the invention is to provide an improved interface module as characterized above, wherein an indication of the operativeness of both the signal generator and amplifier portions of the system is confirmed, as well as that of the voice-override circuit, such indication occurring at the location of the interface module and preferably by a visual modulation monitor, thus assuring the operator or announcer that alarm signals or voice messages originating at the panel are being properly processed, i.e., amplified and passed through the output circuitry of the module and to the speakers. Two such indicators can be provided, one to complement the other, so as to provide redundancy in the monitoring operation. The capability of monitoring both signal and voice transmissions is considered to be extremely important, as for example, where all of the various loud speakers are so remote as to be out of the hearing range of the announcer, or where extremely high ambient noise levels prevent such person from discerning the nature of the sounds emanating from a nearby speaker. Any uncertainty in the reliability of such transmissions is thus virtually eliminated.

The above objects are accomplished in an emergency alarm system having a speaker, a blocking capacitor connected in series with the speaker, and a fire alarm control panel including a pair of sensing terminals thereon, by the provision of unique circuit-failure indicating means comprising a d. c. conducting shunt connected in parallel with the speaker and series blocking capacitor, electrical switching means, an electro-responsive actuator device for operating the switching means, a signal generator connected to the electro-responsive device to energize the same and normally maintain said electrical switching means in closed-circuit condition. In the combination there is provided an electrically conducting loop circuit connected with the sensing terminals of the fire alarm control panel, such loop circuit comprising two speaker lines for connection respectively with the speaker and series connected blocking capacitor that are paralleled by the d. c. conducting shunt. The switching means is connected in series in the loop circuit whereby failure of the signal generator to function will result in the switching means becoming open-circuited, thus to break the continuity of the loop circuit. Breakage of either speaker line of the loop circuit or else opening-circuiting of the switching means will activate the sensing device of the fire alarm control panel to indicate a trouble condition.

The arrangement is such that relatively few components are involved in the supervisory functions of the module, and all indications of possible trouble throughout the system are automatically sent to the fire alarm control panel and not to a point within the interface module. Duplication of a large part of supervisory circuitry is thus avoided, thereby greatly improving the reliability and reducing the cost.

The interface module is adaptable for use with virtually all existing fire alarm control panels, employing an extremely simple hook-up that can be accomplished with no special tools, and with little chance of error on the part of personnel installing the equipment.

Other features and advantages will hereinafter appear.

DESCRIPTION OF THE PREFERRED EMBODIMENT

Figure 1:
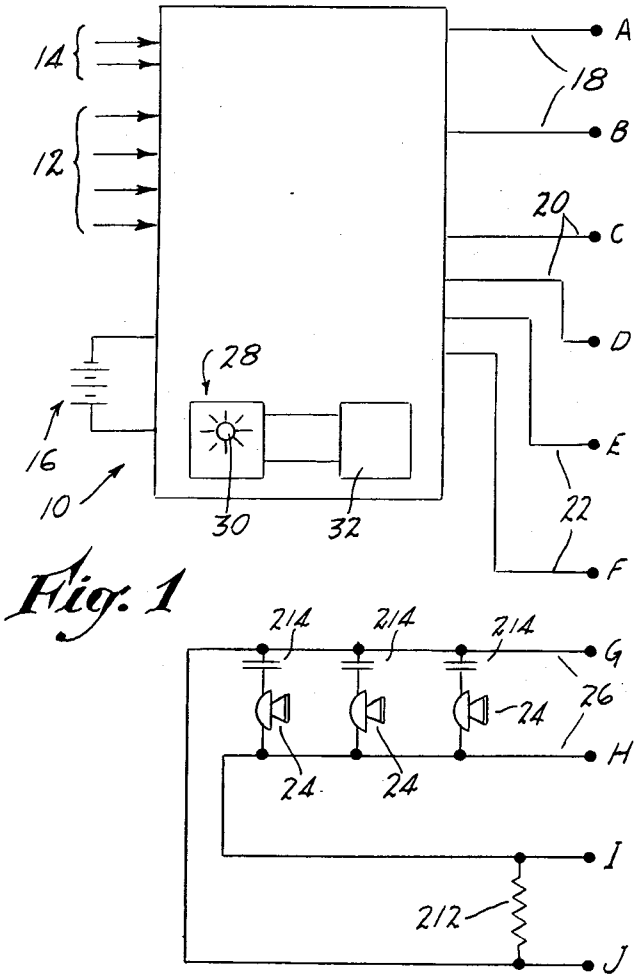
FIG. 1 is a diagrammatic representation of a conventional fire alarm control panel having power input and output lines, alarm sensing lines, and supervisory and alarm lines for connection to external circuitry. This figure also shows a series of loud speakers of conventional design, associated with the alarm system.

Referring to FIG. 1 there is diagrammatically illustrated a fire-alarm control panel generally indicated by the numeral 10, adapted for installation in a building or other structure. Control panels such as this are currently manufactured by a number of different companies, and most such devices function in a similar manner in that they provide input lines which accept signals from remotely located sensing equipment such as smoke detectors, heat detectors, or manually-operated emergency pullboxes, etc. The sensing equipment is generally supervised or monitored as to operativeness by the control panel 10, and electrical connections to such sensing equipment are made by multiple electrical lines indicated at 12. The panel is also supplied with nominal 115 volt a. c. power on lines 14, and in addition is connected with one or more back-up batteries which are maintained charged by suitable charging equipment (not shown) located in or around the panel 10; one such back-up battery is illustrated, indicated by the numeral 16.

The control panel 10 has outputs which provide 115 volt a. c. power on lines 18, nominal 24 volt d. c. power on lines 20 for energizing an interface module to be described below, and in addition, supervisory and alarm functions on lines 22. Those terminals of the fire alarm control panel 10 which are associated directly with the interface module have been indicated by the letters A–F respectively. One or more loud speakers 24 are provided, and permit transmission of audible messages, some of which may be of an emergency nature when conditions are warranted.

On panel 10, the voltage on terminal F is positive with respect to that on terminal E when no alarm condition has been indicated by the sensing equipment connected to one of the input lines 12. During such times, the control panel 10 monitors current flowing in lines 22 in order to verify that there exists continuity in the circuitry connected thereto (and which eventually extend to the various loud speakers 24). By the present invention this current monitoring is accomplished through switching circuits of an interface module to be described below, which result in terminal E being connected with terminal H, and terminal F being connected with terminal G, as will be explained. The supervisory function of the panel 10 in monitoring the integrity of the speaker connections 26 is well known. There is illustrated a functional block 28 within the control panel 10, adapted to sense or monitor current and having a visual indicator 30 of some type such as an LED or incandescent lamp which for example, is normally off but which becomes illuminated in the event that a disruption in the continuity of the speaker lines 26 is detected. Such a lamp would also be arranged to indicate that a "problem" exists with any of the supervised input lines 12, or with other parts of the circuitry contained in the control panel 10.

In addition, the control panel 10 includes a second block 32 constituting a polarity reversing circuit, which operates to reverse the voltage applied to terminals E and F when an alarm condition is detected. Such an alarm condition would be indicated by a signal from one of the sensing devices connected to lines 12, all in the conventional manner.

Figure 2:
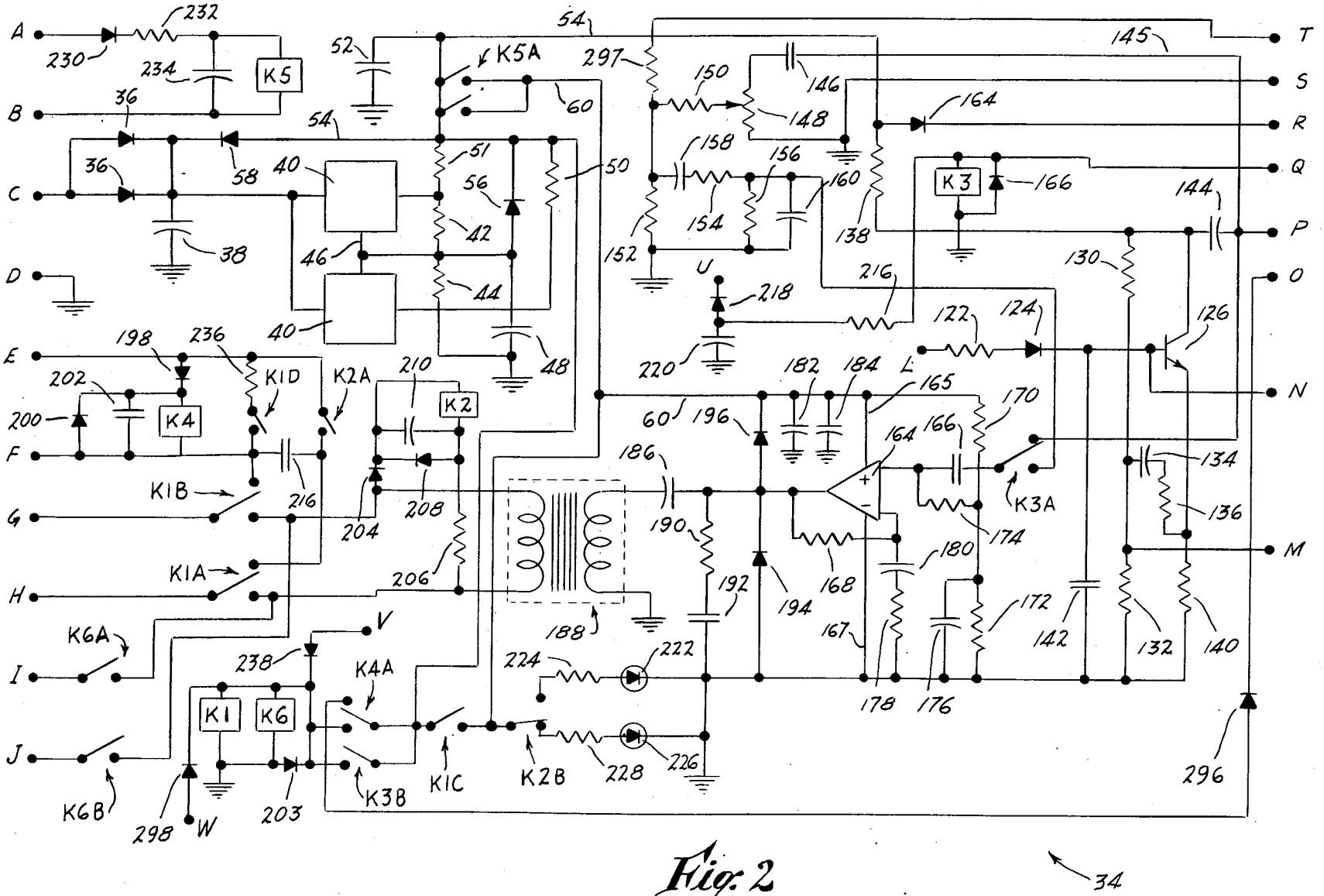
FIGS. 2 and 3 together constitute a complete schematic circuit diagram of the interface module of the present invention, adapted for connection between the existing fire alarm control panel and loud speakers of FIG. 1.
Figure 3:
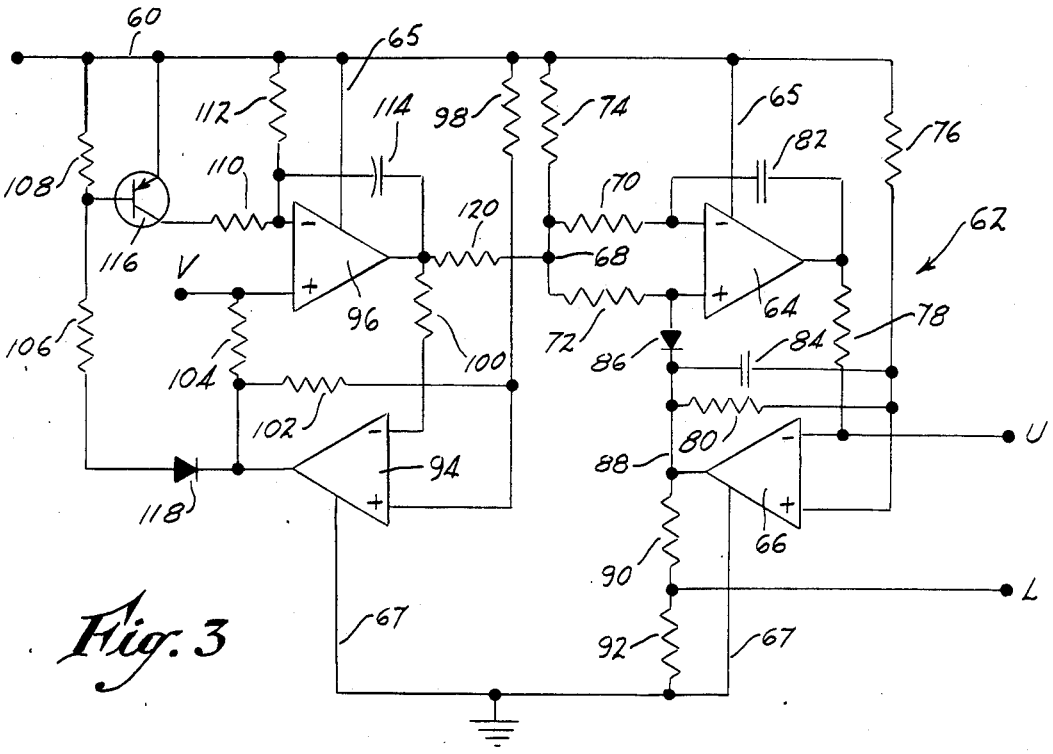

The present improved interface module of the invention is shown in FIGS. 2 and 3. FIG. 2 contains all of the circuitry of the interface module except that involving its signal generator 62, which is shown separately in FIG. 3 due to space limitations. The present interface module is designated 34, and has terminals A–H corresponding to and adapted to be connected with the similarly labelled terminals of the fire alarm control panel 10 of FIG. 1, as noted above. The sheet of drawings containing FIG. 2 can be placed over the sheet containing FIGS. 1 and 4 so that the corresponding leads connected to terminals A–H align.

The module 34 comprises a d. c. voltage regulator in addition to the signal generator 62 shown in FIG. 3, and comprises amplifier circuitry, one or more microphones arranged to drive the amplifier circuitry, an audio transformer interposed between the amplifier circuitry and the various loud speakers, and a number of switch devices at various points about the module, which serve multiple functions to be described below, including controlling the operation of the microphone/alarm circuits, supervisory functions, power preservation in the event of power failure at the control panel 10, and other monitors so as to confirm that the various circuits are operating normally or are functional.

Constant d. c. power is supplied to terminals C and D of the module 34; diodes 36 are in parallel in order to handle the peak currents drawn by the remainder of the module 34. Some control panels 10 supply either raw, full-wave rectified d. c. or else only moderately filtered d. c., and accordingly a filter capacitor 38 is provided in order to smooth out any ripple. The filtered d. c. is then applied to the inputs of two integrated circuit voltage regulators 40 connected in parallel. Again, two are employed in order to handle the peak currents that are involved. The output of one regulator 40 is divided by resistors 42, 44 and fed back to the sensing terminals 46 of each regulator. A capacitor 48 reduces any pick-up of stray signals or other noise which might appear on these terminals 46. Two summing resistors 50 and 51, each on the order of one ohm or so, permit the output currents of the regulators 40 to be added, and also allow for any slight mismatch between the two units, thus avoiding a condition where one regulator unit could conceivably be handling more than its share of the load. The resistors 50, 51 extend to another filter capacitor 52, which reduces noise on the supply line 54 for the module 34. Two diodes 56, 58 are included in order to protect the regulator units 40 by discharging the two filter capacitors 48, 52 respectively in the event that the voltage applied to the regulator input terminals drops. This arrangement prevents a situation from arising wherein the voltages at the output and sense terminals of a regulator are greatly in excess of that appearing at its input, which would likely result in permanent damage thereto.

The supply line, indicated 54, is continuously energized and can be thought of as a "non-interrupted" positive bus or supply line. A second supply line 60 (FIGS. 2 and 3) is provided, extending to signal generator and amplifier circuitry to be described below. The second supply line 60 can be considered an "interrupted" line; it is normally connected to the uninterrupted line 54 by dual relay contacts K5A when a. c. power is being applied from the fire alarm control panel 10 to the interface module 34, but this "interrupted" line is automatically isolated by relay contacts K5A if a power failure occurs, as will be explained later, in accordance with the invention.

The interface module 34 further includes the signal generator 62 particularly shown in FIG. 3, constituted as a voltage controlled oscillator and ramp generator. Four amplifiers are involved, and these can be disposed in a single package. The amplifiers have positive and negative supply lines 65 and 67 respectively. Two of the amplifiers labelled 64, 66 when connected as shown, function as a voltage controlled oscillator having a voltage control input point or line indicated at 68. Associated with the voltage-controlled oscillator are resistors 70, 72, 74, 76, 78 and 80, capacitors 82 and 84 and diode 86. The oscillator output on line 88 is divided down by resistors 90, 92 and fed to terminal L which extends to a correspondingly designated terminal L in FIG. 2 and in turn to a preamplifier transistor stage also shown in FIG. 2 and which will be described below.

The remaining two amplifiers 94, 96 when connected as shown, operate as a ramp generator having a repetition rate of about one Hz. Associated with this generator are resistors 98, 100, 102, 104, 106, 108, 110 and 112, capacitor 114, transistor 116 and diode 118. The output of amplifier 94 consists of a series of spaced, negative-going pulses; the output of the amplifier 96 is a sawtooth wave, which is applied to the voltage control input 68 of amplifier 64 through resistor 120.

As the output of amplifier 96 increases (goes more positive) a point will be reached where the current flowing into the inverting input of amplifier 94 exceeds that flowing into the non-inverting input thereof. This will in turn drive the output of this amplifier 94 low, forward biasing diode 118 and turning on the transistor 116 momentarily. This will drive current into the inverting input of the amplifier 96, causing its output to assume a low state. In turn this low condition is immediately coupled to the inverting input of the amplifier 94, thereby driving its output high and reverse-biasing the diode 118. The transistor 116 turns off, and the output of the amplifier 96 begins to rise again gradually, charging the capacitor 114. When the charging voltage increases sufficiently, the amplifier 94 will again trigger the transistor 116 into conduction for a short interval, discharging the capacitor 114, after which the output of the amplifier 94 will again assume a high state.

The sawtooth wave thus generated at the output of the amplifier 96 is applied, through resistor 120, to the control point 68 of the voltage-controlled oscillator. In operation, when the output of the amplifier 66 is high, diode 86 is reverse biased and the current flowing into the non-inverting terminal is greater than that flowing into the inverting terminal of amplifier 64, causing its output to rise and charging the capacitor 82. This rise is in the form of a positive-going ramp, and a point is reached wherein the current flowing into the inverting input terminal of the amplifier 66 exceeds that flowing into the non-inverting terminal, causing the output of the amplifier 66 to assume a low state. This in turn causes the diode 86 to become forward biased, pulling the non-inverting terminal of the amplifier 64 down and causing its output to fall, and thus discharging the capacitor 82. The fall is in the form of a negative-going ramp, so that at the output of the amplifier 64 there exists a triangular wave. Because the rates of rise and fall are determined by the charging and discharging of the capacitor 82, which in turn is effected by the currents flowing into the inputs of the amplifier 64, a change in the voltage on line 68 affects the oscillation frequency. Accordingly, the sawtooth generator and voltage controlled oscillator produce a waveform at the output of the amplifier 66, which comprises a swept 400–1400 Hz audio wave, one sweep occurring each second or so. There is thus produced a "whoop" signal that has been found to be extremely effective as far as drawing the attention of personnel in the area.

Line 60 in FIG. 3 is part of line 60 in FIG. 2, and terminal U of the circuit of FIG. 3 is employed in connection with a momentary disabling of the signal generator of FIG. 3, as will be further explained.

Referring again to FIGS. 2 and 3, the output of the amplifier 66 is a substantially symmetrical square wave, and after being divided down through the resistors 90, 92 it is fed through terminal L, which is connected to terminal L of FIG. 2. In turn, this latter terminal is connected to a series resistor 122 and isolation diode 124 leading to a transistor pre-amplifier stage 126 which constitutes a part of the amplifier circuitry of the interface module 34. A master microphone 128 (FIG. 4) that is located adjacent to the module 34 is shown connected to terminals M and N. The microphone 128 is preferably of the low-impedance dynamic type, and the coil thereof (not shown) is connected (through terminal M) to the junction of two biasing resistors 130, 132, and connected (through terminal N) to the base of the transistor 126. From the junction of the resistors 130, 132 there extends a series capacitor 134 and resistor 136 that in turn are connected to the emitter of the transistor 126. The impedance at the junction of the resistors 130, 132 is low, and there is thus established a good reference point for connection to that one side of the microphone coil that is not connected to the transistor base. A resistor 138 constitutes the collector load, and together with a resistor 140, the gain of the stage 126 is set. A small amount of negative feedback is provided by virtue of the connection of the resistor 130 to the collector. A small by-pass capacitor 142 at the base of transistor 126 is provided, for stability.

Output is taken off the collector of the transistor 126, through a coupling capacitor 144. An auxiliary output terminal P can optionally be provided.

Figure 4:
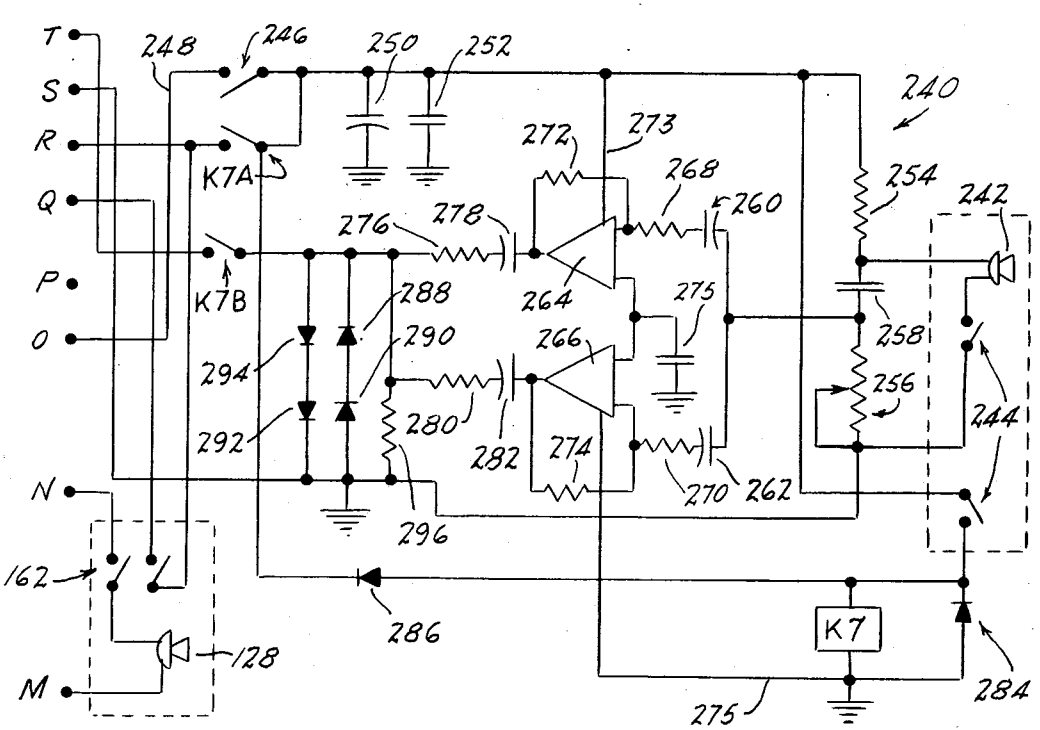
FIG. 4 is a schematic circuit diagram of a remote microphone module optionally employed with the interface module of FIGS. 2 and 3, and also showing a master microphone for use therewith. Both microphones are available for making general public address announcements, and in addition the master microphone is capable of overriding any alarm signals being transmitted by the interface module and thus preventing them from interfering with announcements which may be of an emergency nature.

The sheet of drawings containing FIG. 2 can be placed over the sheet containing FIGS. 1 and 4 such that the leads extending to terminals M, N, etc. align.

The output of the stage 126 is fed along a line 145 through an additional coupling capacitor 146 to a potentiometer 148 constituting an attenuator, the wiper arm of which is connected through a resistor 150 to a bandpass filter comprising resistors 152, 154, 156 and capacitors 158 and 160. The bandpass filter has lower and upper roll-off frequencies of 400 and 4000 Hz respectively. It has been determined that by restricting the transmission of voice signals to this range, improved intelligiblity and understandability can be realized, as compared with voice transmissions which extend over the entire range of response of the human ear, which is typically up to 18 or 20 kHz. The output of the filter extends to the lower one of relay contacts K3A, the coil K3 associated therewith being operated by the push-to-talk switch 162 (FIG. 4) of the master microphone 128. The signal is then fed to the input of a power amplifier stage, to be described.

The master microphone 128 is keyed into operation by the double pole "push-to-talk" switch 162, FIG. 4, one section of which is connected to terminals Q and R. These correspond to terminals Q and R of the interface module 34 of FIG. 2. Terminal R of the interface module 34 provides voltage from line 54 through diode 164, for operation of the master microphone relay coil K3 connected to terminal Q. The relay coil K3 has a diode 166 across it, to supress induced voltages resulting from sudden interruption of the current through it, as can occur when it is de-energized.

The remainder of the amplifier circuitry will now be described. In addition to controlling the contacts K3A, the relay coil K3 controls contacts K3B. As noted, one function of the contacts K3A is, for microphone operation, to complete the circuit from the output of the bandpass filter to the input of an integrated circuit power stage indicated at 164. This stage has positive and negative supply leads 165, 167 respectively. With the coil K3 energized, the contact blade of the section K3A engages the lower contact. The (voice) signal is thus fed through a coupling capacitor 166 to the non-inverting input of the amplifier 164. A resistor 168 from the output provides negative feedback, and establishes the voltage gain. Bias for the non-inverting input is set by resistors 170, 172 and 174, with a by-pass capacitor 176 reducing any noise that might otherwise appear at the junction of these resistors. An RC network 178, 180 connected to the inverting input provides stability to the stage 164. By-pass capacitors 182, 184 are connected to the supply line 60, as shown. Two are employed, one (i.e. the electrolytic) to handle low frequency components of any noise which might appear on the supply line, and the other to take care of higher frequency components. The output of the stage is connected, through a coupling capacitor 186, to the primary of a driver transformer 188 with the other lead of the primary being connected to ground as shown. The output of the amplifier has a series connected resistor 190 and capacitor 192 extending to ground, for stability. Also, diodes 194 and 196 connected from the output of the amplifier stage 164 to the supply line 60 and to ground respectively, prevent this output from being inadvertently driven to a voltage below ground, or above the supply voltage. Diode protection is generally considered beneficial where inductive loads are employed, and would reduce the likelihood of damage to the amplifier 164 during no-load conditions at the transformer secondary, etc., as occur during switching of contacts K1A and K1B. The secondary of the transformer is intended to drive one or more of the loud speakers 24 connected to terminals G and H, through relay contacts to be described below.

The present arrangement has the following important advantage. The amplifier 164 is isolated, as far as d. c. is concerned, from the terminals G, H by the transformer. Further, the amplifier preferably has built-in current limiting, and thus is not damaged by an inadvertent, sustained overload, such as a short-circuit; furthermore the need for fuses is virtually eliminated. Thus, if a fault occurs, the interface module can in all likelihood, withstand the fault and immediately resume normal operation after the fault is corrected.

In accordance with the present invention there is provided in the interface module 34, novel and improved monitoring and switching circuitry which enable the single supervisory circuit 30 in the fire alarm control panel 10 to verify both the integrity of the connections to one or more of the loud speakers 24 that are connected to the module 34, and in addition, to automatically check and verify the operativeness of the signal generator 62 (FIG. 3), the preamplifier 126, the power amplifier stage 164 and transformer 188, not only as to presence of signal, but in addition to confirm the existence of a proper signal magnitude or strength at the output of the transformer 188. As a result, considerably fewer individual components are required in order to carry out the desired supervisory functions, while at the same time there occurs virtually no sacrifice in reliability.

Referring again to FIGS. 1 and 2, as noted above, the fire alarm control panel 10 applies to the terminal F with respect to terminal E, a (+) 24 volt d. c. voltage when no alarm condition exists. In the module, there is shown connected across the terminals E and F in FIG. 2 a relay coil K4 in series with a diode 198. The contacts associated with the coil K4 are indicated K4A. The connection of the diode 198 is such that with the above indicated polarity applied to the terminals E and F, the coil K4 will not be energized. Across the coil K4 is a diode 200, which suppresses induced voltages that result from sudden interruptions in the coil current. A capacitor 202 across the coil K4 is provided, to smooth out any ripple which might otherwise appear, so as to avoid chattering of the contacts K4A. Relay coils K1 and K6 are connected in parallel, and are arranged to be selectively energized during an alarm condition, by any one of a several sources, one being the engagement of the contact blade of K4A with its lower contact. The contact blades of sections K1A and K1B associated with relay coil K1 normally engage the upper contacts in the absence of an alarm condition. A diode 203 is connected across the paralleled coils K1 and K6, for suppression of induced voltages.

In accomplishing supervision of the signal generator 62, the amplifier 126, 164 and the driver transformer 188, an additional relay coil K2 is connected in series with a diode 204 and current limiting resistor 206 across the secondary of the transformer 188. A second diode 208 in parallel with the coil, provides suppression of induced voltages as before. Associated with the coil K2 are contacts K2A and K2B. A capacitor 210 across the coil K2 limits the speed at which the contacts K2A and K2B can operate, for modulation monitoring, as will be explained below.

Assuming that terminal F is positive with respect to terminal E, coil K4 will be de-energized. Relay contacts K2A are in series with the line extending to terminal E, and are normally closed when the relay coil K2 is energized, as when receiving an a. c. signal from the secondary of the driver transformer, which is of a magnitude sufficient to keep the coil K2 fully energized. Under such circumstances, even when no alarm condition exists, the signal generator is operative and there is thus established continuity in the loop from terminal E through relay contacts K2A to terminal H, through one of the pair of leads 26 extending to the loud speakers 24, thence through an end-of-line resistor 212, back through the other of the lines 26 to terminal G, and back to terminal F. The continuity is sensed by the supervisory circuit 28 of the fire alarm control panel 10, and an indication is provided by the lamp 28 to the effect that no problems exist in the speaker lines 26 or in the signal at the output of the transformer 188. By the present invention, both of these supervisory functions are carried out solely through the two terminals E and F. Blocking capacitors 214 are in series with each speaker 24 such that the continuity check is limited to the lines 26 and not to the speaker coils. During supervisory activity of the speaker circuit or loop a capacitor 216 is connected across the line so as to eliminate stray signals which might be picked up, and which could conceivably be carried to a speaker and appear as noise, hum, or other undesirable sound. (The connections to terminals I and J will be explained later).

In the event that one of the speaker lines 26 exterior to the terminals G, H breaks, or a short-circuit occurs between these lines, the continuity sensed through terminals E and F by the fire alarm control panel 10 would be disturbed and a suitable warning given, as by illumination of the lamp 30, to indicate that a problem exists somewhere in the system. The indication may be by means other than illumination of a warning light, such as an audible alert, etc.

Assuming again that no alarm condition exists, if there occurs a loss of signal, or a substantial decrease in signal strength from the secondary of the driver transformer 188, the relay coil K2 will become de-energized, opening the contacts K2A. Again, this interrupts the continuity sensed by the fire alarm control panel 10, and a "problem" condition will be indicated by the lamp 30. Accordingly either type of fault will be detected by the single supervisory circuit 28 of the fire alarm control panel 10, and it can be readily appreciated that a large portion of the overall system is thus being monitored in this manner, with fairly few components. In particular, the integrity of the speaker connections 26 and the functioning of the signal generator 62, pre-amplifier 126, power amplifier 164, and driver transformer 188 are being monitored continuously, by the one supervisory circuit 28. As noted above, this multi-function monitoring capability and the self-diagnostic supervisory capacity are considered to constitute an important feature of the present invention.

When an alarm condition occurs as indicated by a signal applied from one of the sensing devices to one or more of the lines 12 feeding into the fire alarm control panel 10, the output lines 22 of the panel apply a reverse voltage to terminals E and F of the interface module. That is, terminal E becomes (+) with respect to terminal F. As a consequence, diode 198 becomes forward biased, energizing relay coil K4. The corresponding contacts K4A connect the relay coils K1 and K6 to the positive supply line 54, and thus terminals H and G of the module 34 are disconnected from terminals E and F respectively, and instead become connected to the secondary of the driver transformer 188. The output of the signal generator 62 is thus applied via the terminal L, to the stages 126 and 164, the driver transformer 188 and to the speakers 24.

With the swept-frequency alarm signal being transmitted to the speakers, a voice-override (signal shutdown) is made possible with the present circuit arrangement. The voice override can originate only at the master microphone 128, FIG. 4, which is preferably connected at the interface module 34 itself. Upon actuation of the push-to-talk switch 162 on the master microphone 128, a positive voltage is applied to the terminal Q, energizing coil K3, and is also applied through a resistor 216 and diode 218 and through the terminal U to the inverting input of the amplifier 66. The forward bias thus applied to the diode 218 causes shut-down of the signal generator. A capacitor 220 provides a short time delay to keep the signal generator silent during relay contact transfer. The blade of the contacts K3A becomes connected to its lower contact, so that the output of the bandpass filter (upper plate of capacitor 160) drives the stage 164. The preamplifier transistor 126 and power amplifier 164 now respond solely to voice commands originating at the master microphone 128. This feature of the present circuit is considered to be important in that it permits verbal instructions to be directed to all speakers 24 simultaneously, following the initial alert signal put out by the signal generator 62. Following the completion of the instructions, the push-to-talk switch 162 is released and the signal generator 62 automatically re-activated, continuing operation until the entire system is reset by the fire alarm control panel 10.

Also, by the invention, indicator means are provided in the module 34 to confirm or verify the operativeness of the signal generator 62 and also to confirm the presence of modulation at the output of the driver transformer 188. In accomplishing this objective, one of the relay contacts K2B is connected to the supply line 60. With the coil K2 energized as a result of the presence of a signal at the transformer secondary, the contacts can, for example, be arranged to energize a green light such as an LED 222, through resistor 224. In the event of disappearance of the signal from the generator, resulting from failure of the generator itself, or of the amplifier or transformer circuitry, the coil K2 will open, causing the blade K2B to release, and result in energization of a yellow LED 226, through resistor 228, for example. These LED units can be located on the housing or casing of the module 34, in order to provide an indication of the operability of the circuitry noted above. In the event that the master microphone 128 is keyed, the signal generator 62 is automatically shut down, as described above, and the coil K2 will respond to audio (speech) originating at this master microphone. Thus, in the present example, the green and yellow LED units 222, 226 will flicker alternately with one another, or in opposition, with the various voice peaks that occur during speech. If either the audio is not present at all, or is unusually weak, this flickering will not occur, since a weak audio signal will not energize coil K2. Thus a highly reliable modulation indicator is provided at the panel itself. This feature would be desirable for use with installations where the speaker or speakers 24 were located remotely from the interface module 34, such that the party giving the announcement could not hear the echo from a speaker, either because of distance or because of a high ambient noise level.

As noted above, the interface module 34 is powered entirely from the fire alarm control panel 10, and terminals A and B of the module 34 receive nominal 115 volt a. c. power from the panel el 10. The panel's backup battery 16 is automatically switched into service when needed, by circuitry (not shown) in the fire alarm control panel 10. The back-up battery supplies 24 volts d. c. to terminals C and D of the module 34, and in addition supplies the power required by the fire alarm control panel to maintain the supervisory functions of the circuitry 28 and the supervisory and alarm monitoring functions for the lines 12 that are normally provided. If the 115 volt power supplied to lines 14 of the panel 10 is terminated, resulting in loss of a. c. power to terminals A and B of the module 34, coil K5 will deenergize. When a. c. power is being supplied, coil K5 is fed d. c. provided by a diode 230, and has a series resistor 232 and filter capacitor 234. The contacts associated with coil K5 are designated K5A. Dual sections are shown, providing redundancy, for increased reliability. Under conditions when the 115 volt power fails, the contacts K5A disconnect the signal generator 62 from the uninterrupted line 54, as well as disconnecting the preamplifier 126 and power stage 164 therefrom. If this occurs, the supervising of the signal generator, amplifier and transformer is temporarily lost until power is restored; however, the swept-frequency alarm capability as well as the voice override and announcement capability are maintained if an alarm condition arises. Assuming that coil K5 is de-energized as a result of a power failure, if an alarm is indicated on lines 12, the battery-supplied voltage to terminals E and F of the interface module 34 will reverse polarity, causing coil K4 to become energized. This in turn will energize coil K1, and contacts K1A and K1B will connect the speaker or speakers to the secondary of the driver transformer 188; in addition a resistor 236 will be connected across terminals E and F so that the fire alarm control panel 10 does not receive an indication of a fault in the system when the mircophone is keyed. In effect, this resistor 236 constitutes a substitute for the end-of-line resistor 212. Contacts K1C connect the non-interrupted supply line 54 to the interrupted supply line 60, thereby providing power to the signal generator 62, amplifiers 126, 164 and microphone circuits, and initiating the transmission of the normal swept-frequency alarm over the speakers 24, while maintaining the voice override capability. The alarm will continue until the fire alarm control panel is re-set. Of course, the battery drain will be significant during this time, but in all likelihood the capacity will be sufficient to accomplish the desired result, i.e. evacuate the area or alert personnel that an emergency condition exists. By virtue of this power saver circuit provided by the invention, the current drawn by the module, when in a standby condition, can be reduced to around 5 milliamperes or less.

It is noted that even in the absence of an alarm condition, the signal generator 62 and amplifier circuit 126, 164 function continuously. It has been found that with the power levels employed at the driver transformer, the core emits an audible sound as a result of minute vibration. Where the signal generator produces a "whoop" type signal, it can be heard rather distinctly at the location of the interface module 34 (i.e. at the location of the driver transformer 188). While not presenting any danger, it is considered to constitute a nuisance, as well as raising suspicion by unknowing parties that something may be wrong with the system.

In accordance with the invention, means are provided for disabling at least one of the amplifiers of the signal generator, whereby instead of a swept signal, a constant relatively low-frequency tone or "hum" is emitted by the voltage controlled oscillator. In accomplishing the momentary disabling of the sweep function, there is provided a clamping diode 238 connected through the terminal V to the non-inverting input of the amplifier 96. In the absence of an alarm condition, the cathode of this diode is at low voltage, since there is no connection to it other than through the paralleled coils K1, K6 to ground, and the resistive path to ground is typically on the order of several hundred ohms. Accordingly the output of the amplifier 96 is held low, and the control line 68 of the voltage controlled oscillator is also low. The resulting frequency of the square wave emitted by the amplifier 66 is nominally 120 cycles or less, continuous, which produces a low-level hum in the driver transformer 188. It has been determined that this sound is not objectionable; nor does it raise suspicion, as might a "whoop" type sound. The arrangement is such that the diode 238 becomes reverse biased when K1 is energized and the signal generator is connected to power the loud speakers 24, however, so that only the desired, swept signal is ever broadcast to such speakers.

The capability of having one or more remote microphones or microphone modules has been incorporated in the arrangement of the present improved interface module. These preferably do not have the voice override feature of the master microphone 128, since it is considered that announcements of an emergency nature, and having priority override, should originate only at the location of the interface module 34. One such remote microphone module is shown in FIG. 4. Preferably the unit is of a construction similar to that of the master microphone, but incorporates a built-in preamplifier.

FIG. 4 shows, in addition to the master microphone 128, this remote microphone module, generally designated 240. It includes a dynamic microphone 242 and push-to-talk switch 244 having two poles, these parts being shown within the dotted outline. The module has terminals O, Q, R, S and T for connection to the correspondingly-labelled terminals of the interface module 34. An on-off switch 246 is optionally provided in the supply line 248. Two by-pass capacitors 250, 252 filter the d. c. and insure that it is relatively free of undesirable noise which might otherwise appear on the signal transmitted by the remote module 240. Bias for the microphone coil is provided by a fixed resistor 254. A resistor 256 constitutes an attenuator. Coupling capacitors 258, 260 and 262 accept the output from the microphone, and are fed to the inverting input terminals of two complementary amplifiers 264, 266 having input resistors 268, 270 and feedback resistors 272, 274 which determine the gain. A capacitor is connected from the non-inverting input terminals to ground. The amplifiers 264 and 266 are preferably contained in a single package, having positive and negative supply leads 273 and 275 respectively. The outputs of the amplifiers 264, 266 are connected through RC networks 276, 278 and 280, 282 respectively, to one section K7B of a relay, the relay coil being designated K7. One contact of section K7B extends to output terminal T, as shown. The diode 284 across coil K7 suppresses transients, as in the previous cases. Diode 286 provides redundancy or back-up for contacts K7A in the event of inadvertent failure thereof.

Diodes 288, 290, 292 and 294 limit the output voltage swing on terminal T to approximately 1.4 volts peak-to-peak. A low-value load resistor 296, typically under 50 ohms, is connected from the paralleled outputs to ground so as to provide a relatively low output impedance. This has the distinct advantage that shielded cable is not required where runs of even thousands of feet between the remote module 240 and the interface module 34 are involved. Where higher impedance circuits are employed, as for example a microphone of 10K ohm impedance, pick-up of stray signals becomes a problem, since long leads in relatively high impedance circuits tend to act like antennas, resulting in the the appearance of stray signals, noise, 60 Hz hum, and other signals of a spurious nature. With the present arrangement, problems of noise are virtually eliminated. In addition, with a low output impedance, the ability to drive virtually any type of load is maintained (i.e. with the exception of multiple speakers in parallel).

Terminal T in FIG. 4 corresponds to terminal T on the interface module 34 of FIG. 2. In the module 34 is a series resistor 297 connected with the input of the bandpass filter (the junction of resistor 152 and capacitor 158). Audio from the remote microphone 242 is thus applied directly to the stage 164, as opposed to first being amplified by the preamplifier stage 126.

By the present invention means are provided for automatically inactivating such a remote microphone module 240 in the presence of an alarm condition wherein the signal generator is operative and is providing a swept frequency warning signal to the amplifiers, driver transformer and speakers. In accomplishing this objective, contacts K4A associated with the relay coil K4 are connected with a diode 296, FIG. 2, and the opposite end of the diode is arranged to provide power through terminal O, to the remote microphone module only when the coil K4 is de-energized, that is, when the d. c. voltage received from the fire alarm control panel corresponds to a supervisory condition as opposed to an alarm condition. Stated differently, when the voltage on terminal E is (+) with respect to that on terminal F, coil K4 is energized, and the blade of K4A is in engagement with the lower contact in FIG. 2. Accordingly, no voltage is applied to the anode of the diode 296, and operation of the remote microphone module is inhibited. Thus, a swept frequency alarm signal takes precedence or priority over any voice communication from a remote microphone, whereas a voice announcement from the master microphone takes precedence or priority over a swept frequency alarm signal. This particular priority that has been incorporated into the system is considered to be an important feature of the invention, both from the practical standpoint and from the safety standpoint. That is, inadvertent disruption of an alarm signal by personnel operating a remote microphone for the purpose of making an announcement is effectively prevented.

Manual activation of an alarm by means of a suitable switch from a remote location, or from the interface module itself, is made possible by diode 298 and terminal W. The latter, when connected to terminal R, will initiate an alarm signal.

Further in accordance with the invention, means are provided on the interface module to establish a redundant feed to one or more of the speaker units 24, such that even if a feed wire 26 associated with a speaker is severed, all speakers will still respond to alarm signals or voice announcements. In accomplishing this, an additional relay coil K6 is provided, having two sets of contacts, the contacts being capable of connecting the secondary of the driver transformer 188 to terminals I and J of the interface module, as shown, when the coil K6 is energized. Under such circumstances a dual signal path is provided when the lead wires 26 are intact, whereas if one wire 26 breaks at any point along the length of the feed, there still exists a complete path between the transformer 188 and all of the speakers 24. Where connections such as those shown in the figure are employed, the end-of-line resistor 212 would be placed at terminals I and J, such that during supervisory activity at the fire alarm control panel, a break would be detected. (During supervisory activity or monitoring, the relay coil K6 is de-energized. If the end-of-line resistor were placed elsewhere, as for example between two of the three speakers shown, a break in the lines 26 beyond this resistor would not be detected by the supervisory circuit of the fire alarm control panel 10).

It is noted that the present module can also be employed as a public address system at any time, even in the event of failure of the 115 volt a. c. power supplied through the panel 10 to the module 34, or open circuiting of terminals E and F of the control panel 10. When the master microphone relay coil K3 is activated, coils K1 and K6 are energized. In order to prevent the fire alarm control panel from interpreting public address activity as a system fault, contacts K1D are in series with resistor 236 across terminals E and F, such that at the same time that the speakers 24 are connected to the secondary of the driver transformer 188, this resistor 236 is simultaneously introduced across terminals E and F of the module. In this respect the resistor constitutes a substitute for the end-of-line resistor 212 that is employed with the supervision of the speaker circuits.

Also, when the module is employed as a public address system, the relay coil K2 will respond to voice fluctuations by periodically opening and closing with the occurrence of voice peaks and pauses. This will in turn give rise to flickering of the LED units 222 and 226, thereby providing to the announcer an indication that the voice signal is being received at the transformer secondary, and with a magnitude that is at least above a level sufficient to energize relay coil K2. It can be readily appreciated that a weak signal will not provide this type of indication on the LED devices 222 and 226, since in the absence of a strong signal at the secondary of transformer 118 coil K2 will not become energized. An effective and highly reliable modulation indicator is thus provided, and is useable for both emergency and non-emergency situations.

From the above it can be seen that I have provided a novel and improved interface module for fire alarm control panels, which is both simple in construction and reliable in operation. A single set of terminals on the unit is employed to supervise both the speaker circuit and the signal generator/amplifier and transformer, thereby simplifying the required supervision with an absolute minimum number of components required, and simplifying installation.

The interface module can be employed with virtually all existing fire alarm control panels, with a simple six-wire hook up, and including two additional terminals, for speakers.

The power saver circuit significantly reduces battery drain by the module under conditions of power failure; yet the alarm and voice announcement capabilities are fully operable, and useable even during the existence of such a power failure, thus permitting evacuation signals to be broadcast at any time and through all speakers, and allowing the unit to be employed as a public address system under all conditions.

The visual indicators employed provide the operator with highly reliable indications of the operativeness of both the signal generator/amplifier sections of the module, and the audio (voice) portions, even where the speakers are disposed at remote locations out of the hearing range of the party making the announcements.

The device is thus seen to represent a distinct advance and improvement in the field of fire alarm control panels.

Each and every one of the appended claims defines an aspect of the invention which is separate and distinct from all others and accordingly each claim is intended to be treated in this manner when examined in light of the prior art devices in any determination of novelty of validity.

Variations and modifications are possible without departing from the spirit of the invention.

I claim:

1. In an emergency alarm system having a speaker, a blocking capacitor connected in series with the speaker, and a fire alarm control panel including a pair of sensing terminals thereon, circuit-failure indicating means comprising in combination:

(a) a d. c. conducting shunt connected in parallel with the speaker and series blocking capacitor, (b) electrical switching means, (c) an electro-responsive actuator device for operating said switching means, (d) a signal generator connected to said electro-responsive device to energize the same and normally maintain said electrical switching means in closed-circuit condition, (e) an electrically conducting loop circuit connected with the sensing terminals of the fire alarm control panel, said loop circuit comprising two speaker lines for connection respectively with said speaker and series connected blocking capacitor paralleled by said d. c. conducting shunt, (f) said switching means being connected in series in said loop circuit whereby failure of the signal generator to function will result in the switching means becoming open-circuited, thereby to break the continuity of the loop circuit, (g) breakage of either speaker line of said loop circuit or opening-circuiting of said switching means activating the sensing device of the fire alarm control panel to indicate a trouble condition.

2. The invention as defined in claim 1, and further including:

(a) an interface module for connection to the sensing terminals of the control panel, (b) said electrical switching means, electro-responsive actuator device, and signal generator being mounted in said module.

3. The invention as defined in claim 1, wherein:

(a) said switching means comprises a relay having normally closed contacts connected in series with said loop circuit, (b) said electro-responsive actuator device comprising a magnetic coil on said relay, arranged to operate said contacts.

4. An interface module for use with an existing fire-alarm control panel, the control panel being of the type having means for supplying d. c. power to the module, and having a pair of electrical lines adapted to be connected to a pair of terminals on the module, said control panel lines applying d. c. voltage of one polarity when no alarm condition exists, and applying d. c. voltage of the opposite polarity when an alarm condition exists, the module being adapted for driving at least one loud speaker, said module comprising in combination:

(a) signal generator means and an amplifier, said signal generator means being adapted to drive said amplifier, (b) means responsive to application of said d. c. voltage of opposite polarity on said control panel lines, for connecting the output of the amplifier to drive the loud speaker, to thus provide an audible warning to personnel in the vicinity, (c) a microphone capable of producing an input signal to said amplifier, (d) means including a manually-operable switch for terminating the signal from the signal generator means, and for substituting therefor the signal produced by the microphone, whereby the signal from the latter takes precedence over that originating at the signal generator means, and (e) visual indicator means controlled by said amplifier, providing a substantially constant visual reading of the output of the latter when the loud speaker is being driven by the signal generator means and amplifier, and for providing a flickering reading corresponding to voice fluctuations when the loud speaker is being driven by the signal from the mircophone and amplifier, whereby the said one indicator means can either verify the operativeness and signal level of the signal generator means or alternately function as a modulation indicator.

5. The invention as set forth in claim 4, wherein:

(a) said visual indicator means comprises a pair of light-emitting devices, and (b) complementary switching means interposed between said amplifier and said light-emitting devices, for effecting illumination of one device when the other is off, and vice-versa, to provide redundancy for the one light-emitting device if the other inadvertently fails.

6. An interface module for use with an existing fire-alarm control panel, the control panel being of the type having means for supplying d. c. power to the module, and having a pair of electrical lines adapted to be connected to a pair of terminals on the module, said control panel lines applying d. c. voltage of one polarity when no alarm condition exists, and applying d. c. voltage of the opposite polarity when an alarm condition exists, said module containing an amplifier and being adapted for driving at least one loud speaker, and having a coupling transformer between the amplifier and the loud speaker, said module comprising in combination:

(a) signal generator means having an output connected to the amplifier and loud speaker, said signal generator means being adapted to produce a waveform falling in the audible range whereby an attention-attracting warning sound can be selectively provided to personnel in the vicinity of the loud speaker when an alarm condition exists, and (b) automatic control means responsive to absence of an alarm condition, for altering the frequency of the signal generator means wherein sounds produced by vibrations in the core of the transformer are rendered less objectionable than would be the case were the frequency left unaltered.

7. The invention as set forth in claim 6, wherein:

(a) said control means alters the frequency by maintaining it substantially constant at a value below several hundred Hz.

8. An interface module for use with an existing fire-alarm control panel, the control panel being of the type having means for supplying nominal 115 volt a. c. power to the module, means for supplying d. c. power to the module, and having a pair of electrical lines adapted to be connected to a pair of terminals on the module, said control panel lines applying d. c. voltage of one polarity when no alarm condition exists, and applying d. c. voltage of the opposite polarity when an alarm condition exists, said control panel having a d. c. battery constituting a back-up source for said d. c. power supplying means and said d. c. voltage applying means, said module being adapted for driving at least one loud speaker, said module comprising in combination:

(a) signal generator means and an amplifier, said signal generator means being adapted to drive said amplifier, (b) means responsive to application of said d. c. voltage of opposite plarity on said control panel lines, for connecting the output of the amplifier to drive the loud speaker, to thus provide an audible warning to personnel in the vicinity, (c) switching means in said module, responsive to loss of 115 volt a. c. power to the module, for disconnecting said signal generator means and said amplifier from said d. c. power supplying means of the control panel, and preventing them from drawing current therefrom, so as to conserve energy supplied by said d. c. battery, and (d) additional switching means, separate from said first switching means, and responsive to said reversal of d. c. voltage applied to said pair of terminals on the module, for reconnecting the signal generator means and amplifier to the d. c. power supplying means of the control panel, thereby enabling the interface module to operate for a limited time if an alarm condition arises while the 115 volt a. c. power is still absent.

9. An interface module for use with an existing fire-alarm control panel, the control panel being of the type having means for supplying nominal 115 volt a. c. power to the module, means for supplying d. c. power to the module, and having a pair of electrical lines adapted to be connected to a pair of terminals on the module, said control panel lines applying d. c. voltage of one polarity when no alarm condition exists, and applying d. c. voltage of the opposite polarity when an alarm condition exists, said control panel having a d. c. battery constituting a back-up source for said d. c. power supplying means and said d. c. voltage applying means, said module being adapted for driving at least one loud speaker, said module comprising in combination:

(a) a microphone and an amplifier, said microphone being adapted to drive said amplifier, (b) means responsive to application of said d. c. voltage of opposite polarity on said control panel lines, for connecting the output of the amplifier to drive the loud speaker, to thus enable an audible verbal warning to be given to personnel in the vicinity, (c) switching means in said module, responsive to loss of 115 volt a. c. power to the module, for disconnecting said amplifier from d. c. power supplying means of the control panel and preventing it from drawing current therefrom, so as to conserve energy being supplied by said d. c. battery, and (d) additional switching means, separate from said first switching means, and responsive to operation of said microphone, for re-connecting the amplifier to the d. c. power supplying means of the control panel, thereby enabling the interface module to operate for a limited time as a public address system if an alarm condition arises while the 115 volt power is still absent.

10. An interface module for use with an existing fire-alarm control panel, the control panel being of the type having means for supplying d. c. power to the module, and having a pair of electrical lines adapted to be connected to a pair of terminals on the module, said control panel lines applying d. c. voltage of one polarity when no alarm condition exists, and applying d. c. voltage of the opposite polarity when an alarm condition exists, the module being adapted for driving at least one loud speaker, said module comprising in combination:

(a) signal generator means and an amplifier, said signal generator means being adapted to drive said amplifier, (b) means responsive to application of said d. c. voltage of opposite polarity on said control panel lines, for connecting the output of the amplifier to drive the loud speaker, to thus provide an audible warning to personnel in the vicinity, (c) a master microphone capable of producing an input signal to said amplifier, (d) an auxiliary microphone capable of producing an input signal to said amplifier, (e) means including a manually operable switch, for isolating the auxiliary microphone from the interface module at any time during which the an alarm condition arises and during which the signal generator means is driving the loud speaker, and (f) means including a manually operable switch, for terminating the signal to the loud speaker from the signal generator means, and for substituting therefor any signal originating at the master microphone, whereby the signal from the latter takes precedence over that originating at the signal generator means.

* * * * *